US007503460B1

(12) United States Patent
Petricio Yaksic

(10) Patent No.: US 7,503,460 B1
(45) Date of Patent: Mar. 17, 2009

(54) GANTRY CRANE

(76) Inventor: Davor Petricio Yaksic, La Colpa 681, Sector la Chimba, Casilla 902, Antofagasta (CL)

( * ) Notice: Subject to any disclaimer, the term of this patent is extended or adjusted under 35 U.S.C. 154(b) by 407 days.

(21) Appl. No.: 10/956,349

(22) Filed: Oct. 4, 2004

(51) Int. Cl.
*B66C 5/02* (2006.01)
*B66C 17/00* (2006.01)
*B66C 19/00* (2006.01)

(52) U.S. Cl. ..... 212/344; 212/324; 212/312; 104/126

(58) Field of Classification Search ..... 212/324, 212/344, 312; 104/126
See application file for complete search history.

(56) References Cited

U.S. PATENT DOCUMENTS 1,433,993 A * 10/1922 Fitch ..... 212/332
2,343,014 A * 2/1944 Langan ..... 212/324
2,449,501 A * 9/1948 Oertle ..... 52/651.01
3,081,883 A * 3/1963 Minty ..... 212/344
3,257,968 A * 6/1966 Minty et al. ..... 105/163.2
4,041,875 A 8/1977 Wallace
4,227,464 A * 10/1980 Wallace ..... 104/126
4,334,480 A 6/1982 Wallace
4,657,150 A * 4/1987 Glickman et al. ..... 212/344
4,708,048 A * 11/1987 Brown et al. ..... 89/1.805
4,877,206 A * 10/1989 Barrett ..... 248/49
4,927,034 A * 5/1990 Holden ..... 212/324
5,022,542 A 6/1991 Beier
5,360,123 A 11/1994 Johnston
5,385,249 A * 1/1995 Long, Jr. ..... 212/324
6,010,019 A * 1/2000 Johnston ..... 212/324
6,382,437 B1 * 5/2002 Okada et al. ..... 212/274

* cited by examiner

*Primary Examiner*—Patrick Mackey
*Assistant Examiner*—Terrell H Matthews
(74) *Attorney, Agent, or Firm*—James Creighton Wray; Clifford D. Hyra

(57) ABSTRACT

A gantry crane has a rigid open three-dimensional truss cross-beam. A lower I-beam and parallel upper X-beams are interconnected with angular gussets and angle irons forming a triangular open beam bounded by three trusses. Angular gussets on the sides are as parallel members to provide maximum strength. One end support is rigid, with upper ends of legs having plates bolted to one end plate extending between the X-beams. Outrigger legs have an upper plate bolted to a sloped plate at an extended end of the I-beam. Vertical support legs at the other end have a strengthening cross-member and upper vertical plates which are bolted to the end plate on the X-beams. The unusual cross-beam structure and the unusual rigid leg structure and rigid interconnection provide rigidity of the entire crane. The vertical support legs accommodate variations in tracks.

29 Claims, 7 Drawing Sheets

GANTRY CRANE

BACKGROUND OF THE INVENTION

Gantry cranes are widely used throughout the world to move heavy equipment within warehouses and storage yards and to load and unload freight vehicles. The gantry cranes have overhead beams on which trolleys with cable winders, sheaves and hooks ride on wheels from side to side to raise, lower and laterally move loads. Carriages are usually provided at the bottoms of legs which support the beams. The carriages move the gantry cranes along a floor or on tracks to approach, lift, reposition and deposit loads as cable winders on the trolleys are activated and the carriages are moved.

Existing gantry cranes are cumbersome and are difficult to move between locations, and cranes are heavy and are difficult to transport to locations and to erect at the locations because of the great weight that is required to provide the strength of the cranes. Lightweight cranes are unsuited for lifting significant loads.

Needs exist for new and improved gantry cranes.

SUMMARY OF THE INVENTION

The new gantry crane is transportable in sections and is easily erected and bolted together at five points. The crane is strong and rigid, and is designed to withstand operational load stresses and to compensate for irregularities in the tracks on which it rolls while in operation.

A load bearing I-beam is at the bottom of an inverted triangular cross-section truss. Angularly, related gussets in the truss are connected at their bottoms to plates welded to the I-beam. Tops of the gussets are connected to plates welded between pairs of two longitudinally extended oppositely oriented angle irons on both sides of the top of the inverted triangular truss. The pairs of opposite angle irons operate as rigid X-beams. Angularly oriented angle irons extend across the top. Their ends are connected to plates which are welded to the X-beams. Legs of the crane are pipes connected to cross-plates at the ends of the X-beams. One end has additional outward sloping triangularly arranged outrigger legs which are connected to a sloped plate at a cantilevered end of the main beam. At the other end of the crane, vertical plates are welded at the tops of the pipe legs and are bolted to the end cross plate on the X-beams. The vertical plates at the top of the legs provide limited flexibility for accommodating floor and rail irregularities.

A gantry crane has a rigid open three-dimensional truss cross-beam. A lower I-beam and parallel upper X-beams are interconnected with angular gussets and angle irons forming a triangular open beam truss bounded by three trusses. Angular gussets on the sides are formed as parallel members to provide maximum strength. One end support is rigid, with upper ends of legs having plates bolted to a first end plate extending between the X-beams. Outrigger legs have an upper plate bolted to a sloped plate at an extended end of the I-beam. Vertical support legs at the other end have a strengthening cross-member and upper vertical plates which are bolted to a second end plate on the X-beams. The unusual cross-beam structure and the unusual rigid leg structure and rigid interconnection provide rigidity of the entire crane. The vertical support legs accommodate variations in tracks.

A new gantry crane has a rigid open three-dimensional horizontal beam having first and second ends. A rigid open three-dimensional leg structure is rigidly connected at the first end of the rigid open three-dimensional beam. A vertically supporting second leg structure is connected to the second end of the rigid open three-dimensional beam.

Flexible connectors are connected between the tops of the vertically supporting leg structure and the second end of the beam. A transverse end plate is connected at the top of the second end of the beam, and vertical plates are connected between the end plate and tops of the second leg structure. The second leg structure has first and second inward sloping tubes having upper ends connected to vertical plates in vertical planes and having lower ends connected to horizontal plates.

Carriage housings have axles extending horizontally through the housings and wheels mounted on the axles. Horizontal plates at the bottoms of the legs are connected to the carriage housings.

The rigid leg structure has first and second upward and inward converging vertical legs and vertical connection plates at the tops of the first and second legs for connection to a cross-beam end plate at the top of the open three-dimensional horizontal beam. A lower member of the horizontal beam has an extended first end which extends outward between the first and second legs. Third and fourth upward extending, inward converging and outwardly sloping legs form a torque-resistant triangular box. A top plate is connected to tops of the third and fourth outwardly sloping legs. A complementary sloping end plate is connected to an extended end of the lower beam member. The sloping end plate is bolted to the top plate at the tops of the third and fourth legs. A carriage is connected to bottoms of the first, second, third and fourth legs, axles connected to the carriage near ends of the carriage, and wheels connected to the axles. First and second horizontal plates are connected respectively at bottoms of the first and third legs and at bottoms of the second and fourth legs. The horizontal plates are connected to the carriage.

Preferably the first, second, third and fourth legs are tubular legs. An inverted triangular rigidifying support is connected between the first and second legs. The inverted triangular support has a downward pointing apex connected centrally to the carriage and vertical divergent support legs extending upwardly and outwardly from the apex to mid points of the legs. A cross-member base extends between the two middle portions of the first and second legs at the upper ends of the rigidifying support legs, completing the welded triangular reinforcement. Preferably the triangular reinforcement support legs and the base are tubular members.

First, second and third medial support tubes respectively extend between the first and third, the third and the fourth and fourth and second legs at positions near the cross member base to provide further strengthening and rigidifying support.

An end plate is connected at one end of the open three-dimensional beam. Angular support plates extend outward, downward and inward from ends of the end plate on the beam. Gussets extend downward and inward from the angular support plates to the sloping plate fixed on the extended first end of the lower member.

The open three-dimensional beam has a longitudinally extending lower member having a vertical web and oppositely extending lower horizontal flanges for supporting a movable crane trolley. First and second spaced longitudinally extending upper members are parallel to the lower member. Upper cross-members extend between the first and second upper members, and angular gussets extend between the lower member and the first and second upper members. Preferably the upper members are X-beams, and the upper cross-members extending between the upper members are angle irons. Each upper member X-beam is formed from two angle irons mounted as X-shapes. The angle irons are connected at intervals alternately by downward and inward sloping plates and by upward and inward sloping plates.

Each downward and inward extending plate is connected to two different pairs of gussets extending at angles to each other.

In preferred embodiments, each gusset pair has two parallel members. Upper end portions are connected to the downward and inward extending plates. Upward and outward extending lower plates are welded to the lower I-beam member. Lower ends of the gussets are connected to the upward and outward extending lower plates. Each upward and outward extending lower plate and each downward and inward extending upper plate is connected to two different gussets extending in different directions. Gussets at the ends of the three-dimensional beam extend upward and diagonally outward and are connected to ends of the upper members and to the end plates.

Each gusset has spaced parallel elements which are connected at lower and upper ends respectively to the upward and outward extending plates and to the downward and inward extending plates. The gussets have spacers connected between the two parallel elements at intervals along the gussets. The upper cross-members extend angularly between the longitudinal upper members.

A trolley has wheels mounted on outward extending flanges of the lower member. A drive motor is operatively connected to at least one of the wheels for moving the trolley back and forth along the lower member. Pulleys are mounted on the trolley. A winding motor is mounted on the trolley and is connected to a reel. A cable is connected to the reel and is connected to the pulleys and to a movable sheath supported by multiple strands of the cable. A hook is supported by the movable sheath for lifting and lowering loads.

Carriages are mounted on the lower ends of the leg structures at first and second opposite ends of the crane. Axles are mounted on the carriages, and roller wheels are mounted on the axles. Synchronous, stepping or frequency drive motors are connected to wheels on the carriages for moving the carriages back and forth along rails. If one or more motors fail, a single motor and drive wheel can drive both carriages.

These and further and other objects and features of the invention are apparent in the disclosure, which includes the above and ongoing written specification, with the claims and the drawings.

DETAILED DESCRIPTION OF THE PREFERRED EMBODIMENTS

Figure 2:
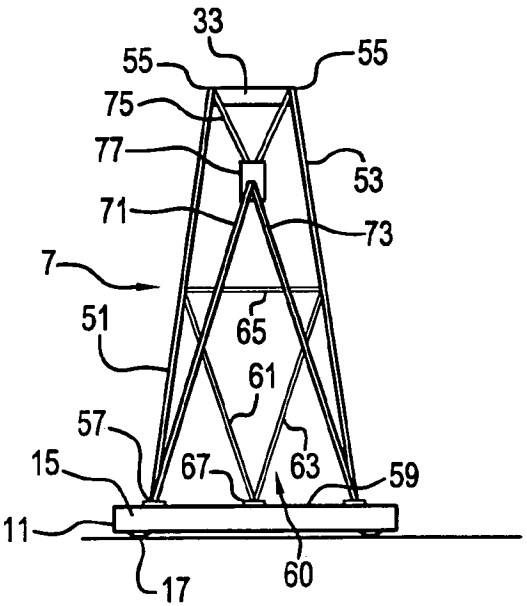
FIG. 2 is a left side elevation of the gantry crane shown in FIG. 1.

The gantry crane of the invention is generally indicated by the numeral 1. The gantry crane has an upper open truss three-dimensional cross-beam generally referred to by the numeral 3. The beam 3 is supported rigidly at a first end 5 by a rigid leg structure 7. A second end 6 of beam 3 is supported by vertical support legs 9. Carriages 11 and 13 are connected to the bottoms of rigid support legs 7 and to the bottoms of vertical support legs 9, respectively. The carriages have axles 15 and wheels 17, at least some of which are driven, preferably by synchronous motors, frequency motors or stepping motors to assure that the carriages move together when on tracks. Because of the unique construction, if one motor fails, the remaining motor or motors may move the crane successfully.

The three-dimensional open beam 3 has a lower member 21, which is preferably an I-beam with a vertical web 23 and lower oppositely extending flanges 25, on which wheels 27 of a trolley 29 ride. Beam 3 has two upper members 31, which are constructed as X-beams and which are provided at opposite ends with cross-member end plates 33 and 35, respectively.

A first end 37 of the I-beam lower member 21 extends axially outward beyond the upper members 31, which are connected to end plate 33. A second end 39 of the lower member 21 is spaced slightly inward from the second ends of the upper members 31, which are connected to the end plate 35. Gussets 41 connect the upper and lower members. Preferably each gusset has first and second parallel elements 43 and 45, which are connected between downward and inward extending plates 47 on the upper members 31, and upward and outward extending plates 49 on opposite sides of the lower member 21.

Figure 1:
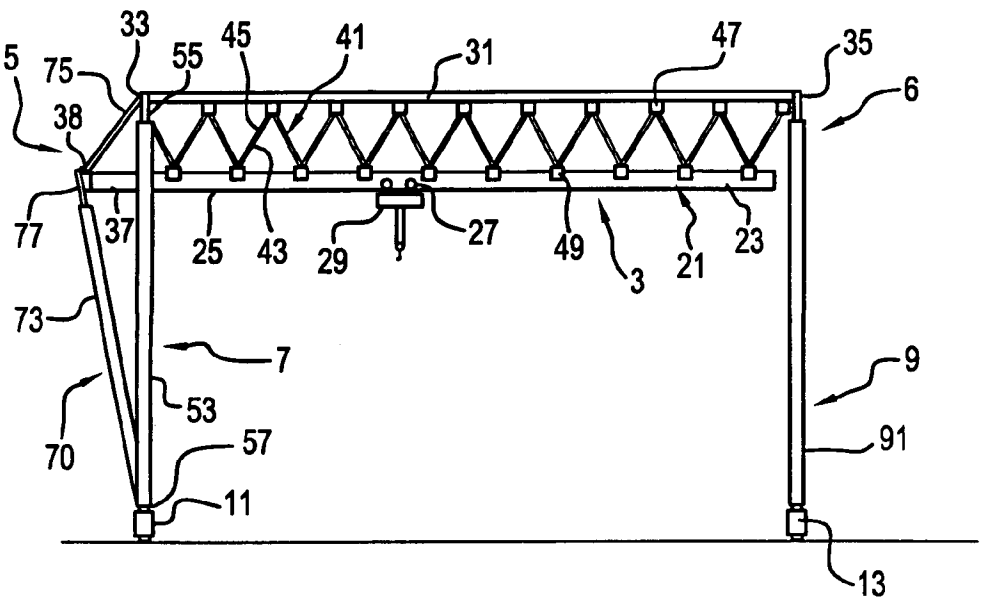
FIG. 1 is a front elevation of the gantry crane of the invention.

At the rigidly fixed end 5, as shown in FIGS. 1 and 2, the support structure 7 comprises first and second tubular legs 51 and 53, each having top plates 55 connected to the end plate 33 by bolting the top plates 55 to an inside of end plate 33. Bottoms of legs 51 and 53 are welded to bottom plates 57 on the top 59 of the carriage 11. Preferably legs 51 and 53 are steel tubes having 6" diameters.

As shown in FIG. 1, the extended end 37 of the lower member 21 has a welded sloped end plate 38. The legs 51 and 53 have an inverted triangular reinforcement 60 with outward and upward sloping legs 61 and 63, and a horizontal base 65. Upper ends of reinforcing legs 61, 63 and base 65 are welded to the legs 51 and 53. A plate 67 at the lower ends of reinforcement legs 61 and 63 connects the legs to the upper surface 59 of the carriage 11.

A rigidifying outrigger structure 70 has legs 71 and 73 which extend inward and upward from lower plates 57, which are mounted on top of carriage 11 to a mounting plate 77, which is bolted to plate 38. Gussets 75, which are similar to gussets 41, extend from the upper end plate 33 downward and inward to the mounting plates extending inward from end plate 38. The lower ends of gussets 75 are welded to the inward extending mounting plates. The upper ends of legs 71 and 73 are grooved and welded to the mounting plate 77.

Mounting plate 77 is secured by bolting it onto the mounting plate 38 at the extended end 37 of the lower beam 21.

Figure 4:
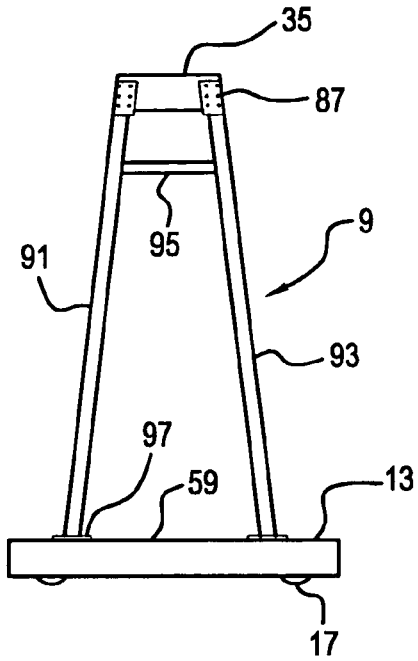
FIG. 4 is a right side end view of the gantry crane shown in FIGS. 1-3.
Figure 5:
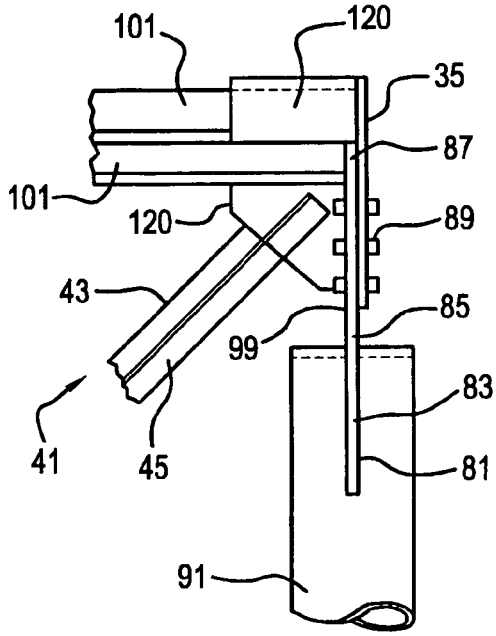
FIG. 5 is a detail of the connections between elements at the end of the gantry crane shown in FIG. 4.
Figure 6:
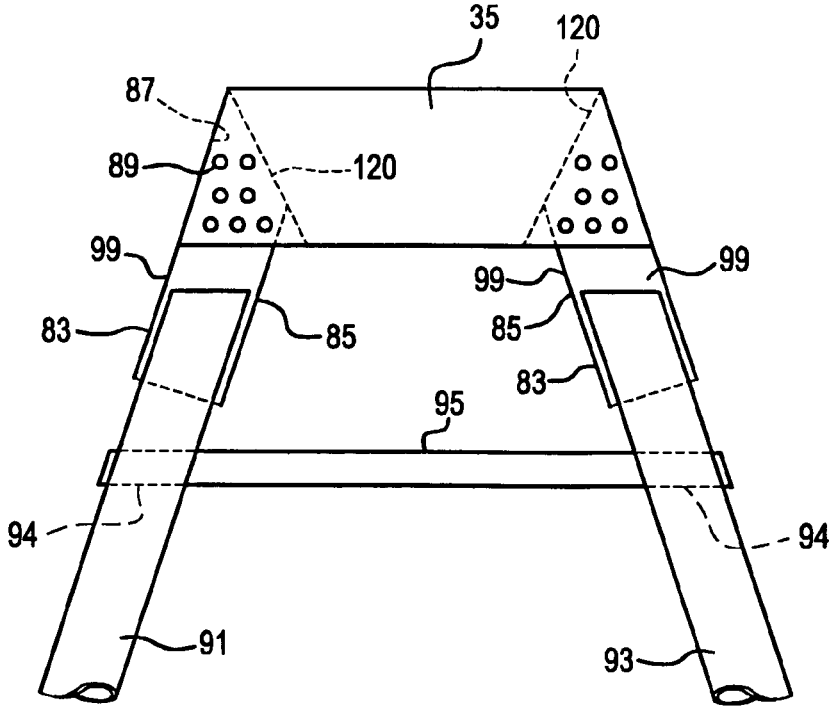
FIG. 6 is an end elevation detail of the connections of the gantry crane end shown in FIGS. 4 and 5.

The vertical support legs 9, as shown in FIG. 4, have upward and inward sloping legs 91 and 93 in a vertical plane. A cross-member 95 is welded near the tops of legs 91, 93. Bottom plates 97 are welded to lower ends of legs 91 and 93 and are secured to the top 59 of trolley 13. As shown in FIGS. 5 and 6, upper ends of the legs are slotted 81 to receive the lower ends 83 of vertical plane plates 85, which are connected to end plate 35 of the horizontal member, preferably with bolts. The lower ends 83 of the vertical plates 85 are welded in the slots 81 in the upper ends of the legs 91 and 93. The upper ends 87 of plates 85 are bolted 89 to the inside of the end plate 35. Medial portions 99 of the vertical plates are flexible to ensure vertical support while compensating for variations in tracks 100, which otherwise might stress the structure. FIGS. 5 and 6 show end mounting plates 120 which are welded to end plate 35 and between the angle iron members 101 of x-beams 31.

As shown in FIG. 6, the cross reinforcement member 95 is extended through holes 94 and is welded on both sides of the holes 94 in the legs 91 and 93 to rigidify the leg structure 9.

In FIG. 5, reinforcement plates 101 are shown connected to the cross-member end plate 35, to the X-beams 31 and to the end gussets 41 for rigidifying the beam structure.

Figure 3:
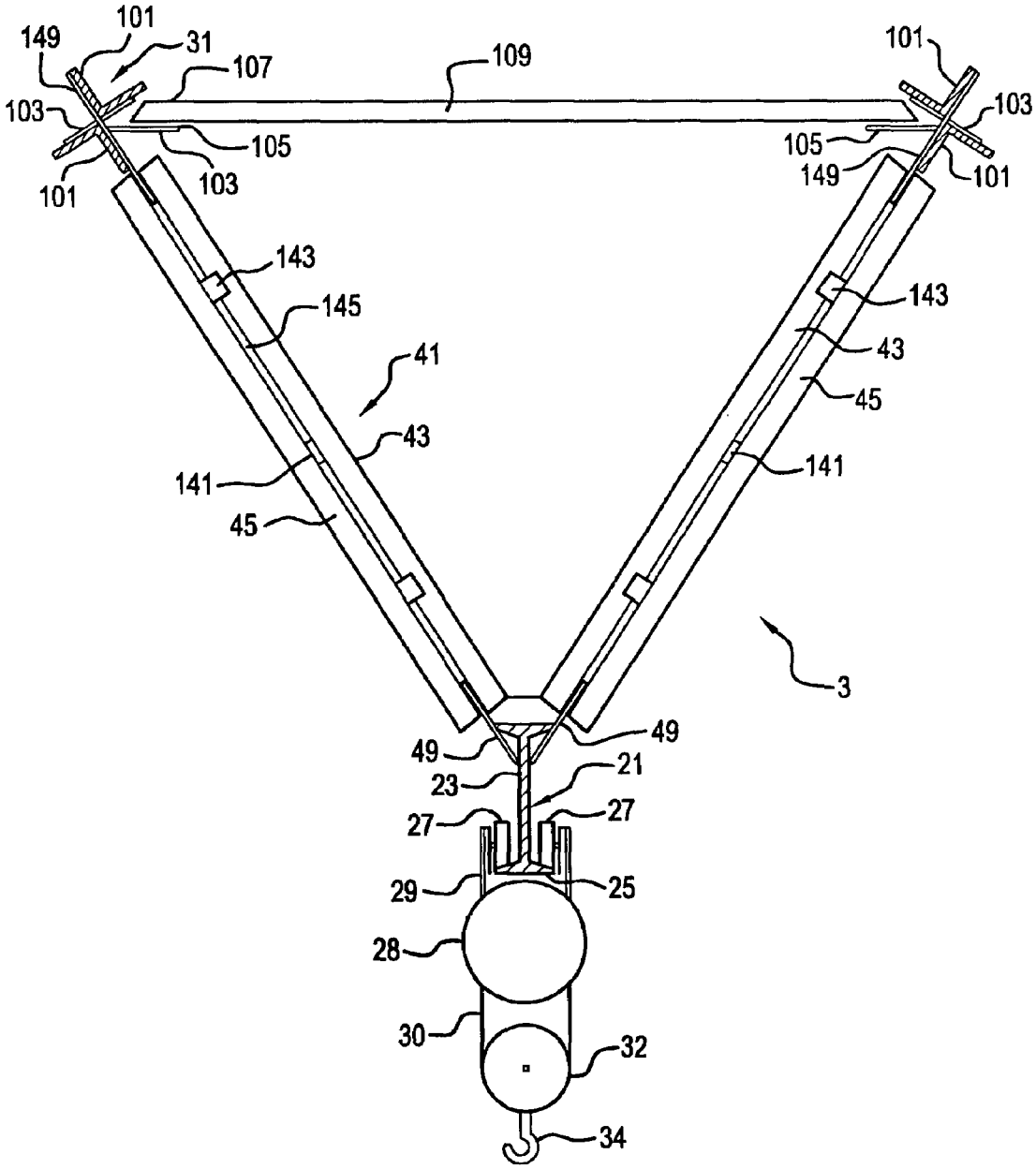
FIG. 3 is a cross-section through the main three-dimensional beam which extends between opposite ends of the gantry crane shown in FIGS. 1 and 2.

As shown in FIG. 3, the main beam 3 is constructed as an open triangular cross-sectional tubular area having a main lower beam 21 with lower flanges 25 on which wheels 27 of a trolley 29 ride. The trolley houses pulleys 28, which cooperate with multiple strands 30 of cable to raise and lower the sheaves 32 on which hook 34 is mounted. Plates 49 are welded to the vertical web 23 of the I-beam 21, and also to the upper flange of the I-beam. The lower plates 49 slope upward and outward and are welded to outer and inner gusset members 43 and 45, which form the angularly disposed gussets. The gussets 41 have welded spacers 141 and straps 143, which maintain the space 145 between the gusset elements 43 and 45. Downward and inward extending plates 149 are welded between the upper ends of the gusset members 43 and 45. The longitudinally extending members 31 of the main cross beam 3 are formed from opposite angle irons 101, which are welded to the upper inward and downward sloping plates 149. Between the plates 149 the angle irons are welded to plates 103, which are interposed between the plates 149 and which are bent inward. The inner portions 105 of plates 103 are welded to the ends 107 of angle iron cross-members 109, which are positioned at angles along the top of the open three-dimensional cross-beam. The result is a rigid open truss cross-beam member 3 formed of three diagonally arranged trusses, two on the sides and one on the top. The open truss cross-beam member 3 has strong and rigid longitudinally extending manufactured X-beams 31 at the top and I-beam 21 at the bottom of the rigid open three-dimensional cross-beam 3. The X-beams are formed by the longitudinally extending oppositely directed angle irons which are welded to plates at intervals.

Figure 7:
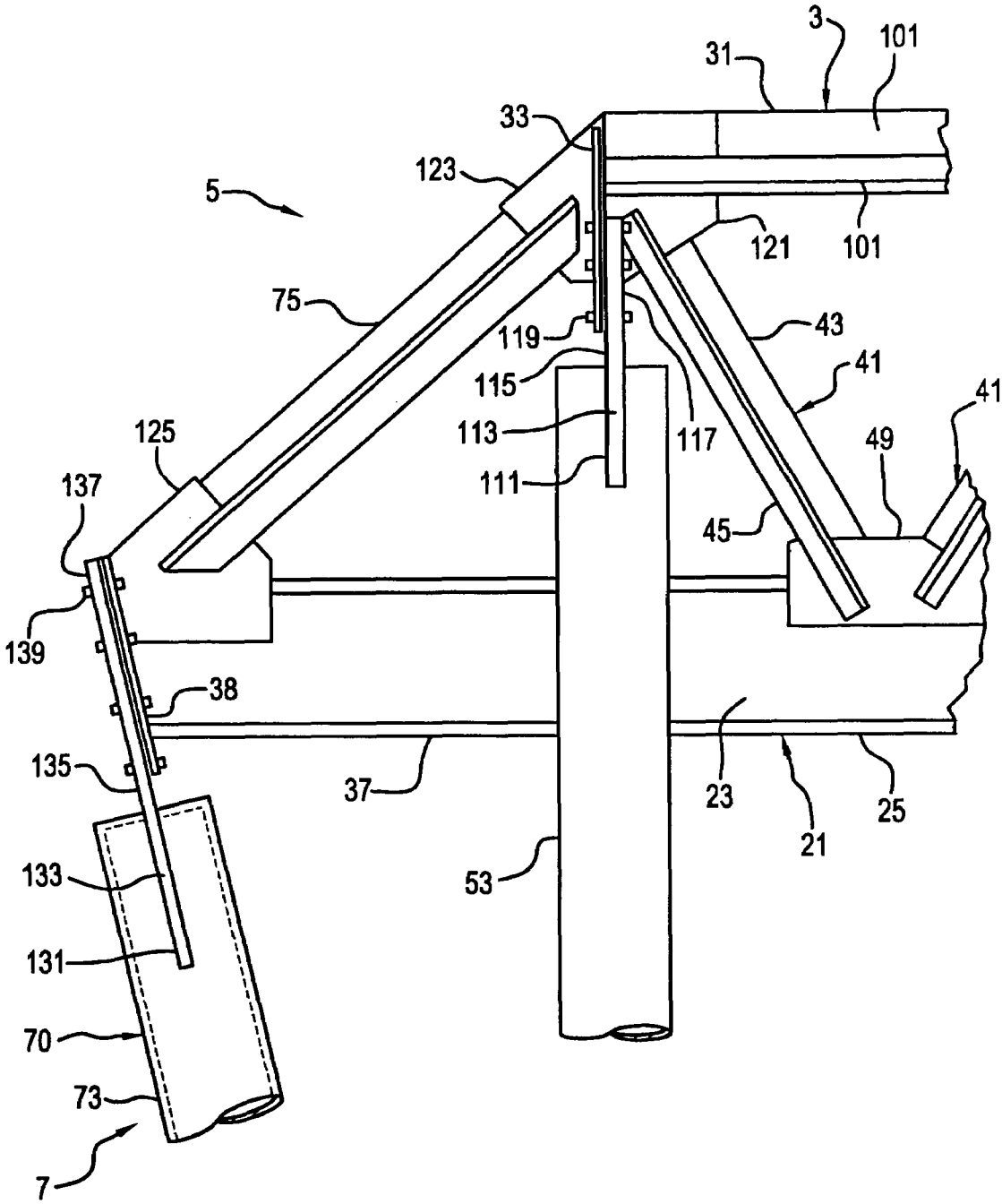
FIG. 7 is a front elevational detail of the left end of the gantry crane shown in FIGS. 1 and 2.

FIG. 7 shows a detail of the rigid interconnection at the first end 5 of the structure between the horizontal open three-dimensional beam 3 and the rigid leg structure 7. As shown, each upper end of the vertical legs 51 and 53 is slotted 111, and the lower end 113 of a vertical plate 115 is inserted into and welded in the slot 111. The upper end 117 of each vertical plate 115 is bolted 119 inside the end plate 33 at the ends of the X-beams 31. Reinforcement plates 121 are welded to the X-beams and to the end plate 33. The upper ends of the gusset members 43 and 45 are welded to the plates 121. Each lower plate 49 receives the lower ends of two adjacent gussets. Both have lower ends of members 43 and 45 welded inside and outside the plates 49. Outer upper plates 123 are welded to the outside of end plate 33, and lower plates 125 are welded to the inside of the sloped end plate 38 and to the top flange of I-beam 21 to hold the outer gusset members 75. The lower ends of the gussets members 75 are welded to the inward extending plates 125. The upper ends of the outrigger legs 73 and 71 are slotted 131 to receive the lower end 133 of plate 135, which is welded in the slots. Upper end 137 of the plate 135 is bolted 139 to the sloped end plate 38, which is welded on the extended end 37 of the lower I-beam 21.

Figure 8:
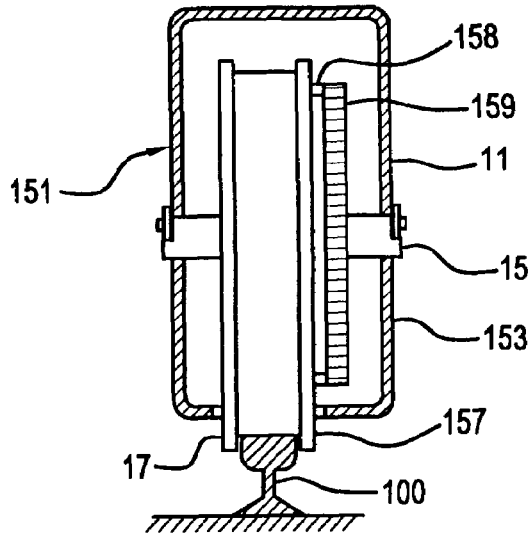
FIG. 8 is a perspective view of the gantry crane of the present invention.

FIG. 8 shows a detail of one of the trolleys 11. The trolley has an axle 15, which extends through opposite sides 153 of the trolley housing 151. Each support wheel 17 has flanges 157, which engage opposite sides of rail 100.

Gear 159 is connected 158 to one wheel on each trolley or both wheels on both trolleys. The gear is driven by direct coupled synchronous, stepper or frequency motors and speed reducers.

Figure 9:
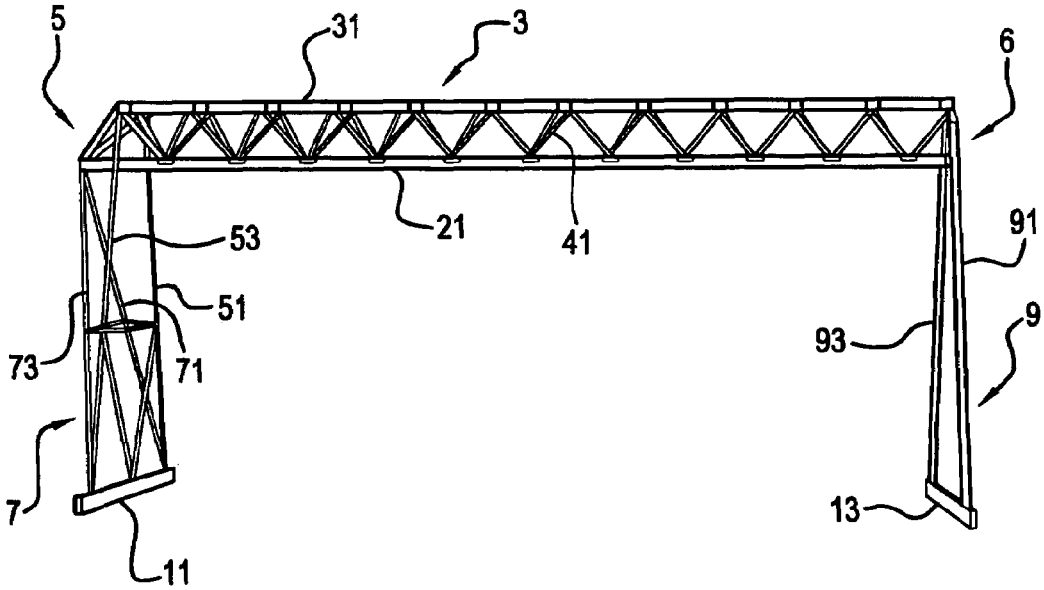
FIG. 9 is a perspective view of the new gantry crane.

FIG. 9 is a perspective view of the gantry crane 1 shown assembled on site.

Figure 10:
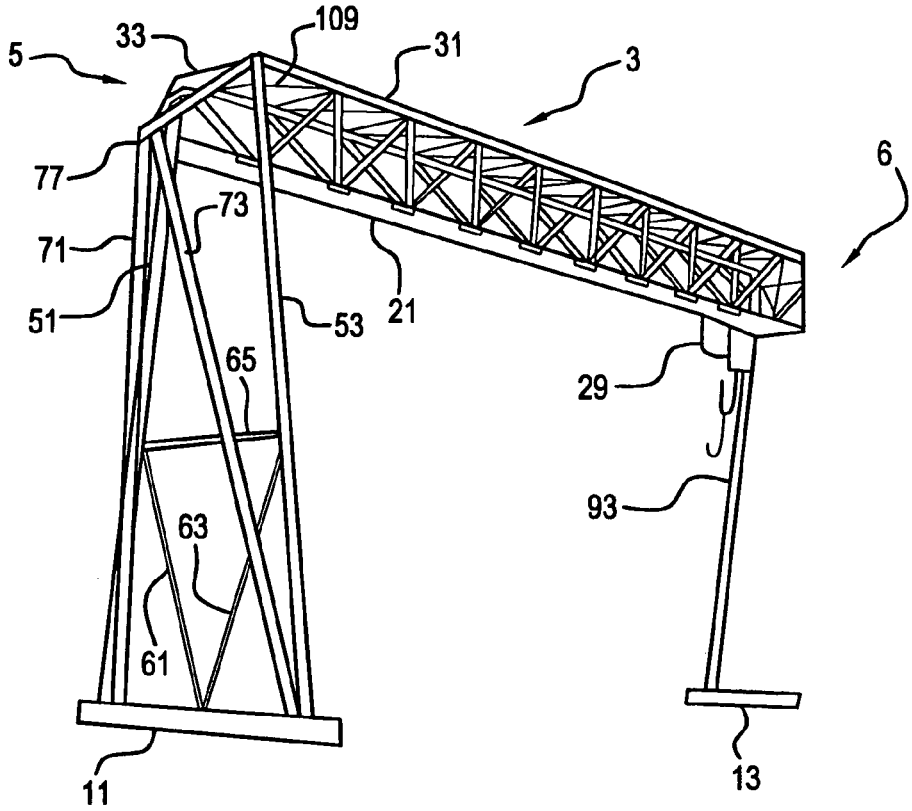
FIG. 10 is a perspective view taken from the first end at the left of the new gantry crane shown in FIGS. 1 and 9.

FIG. 10 is a perspective view of the gantry crane 1 taken from the end 5 with the rigid leg structure 7. Angular interconnections of top cross-member angle irons 109 are shown.

In FIGS. 9 and 10, intermediate reinforcement tubes 170 interconnect and rigidify legs 51 and 71, 53 and 73, and legs 71 and 73. Tubes 170 lie in a plane perpendicular to outrigger legs 71 and 73 at the base 65 of reinforcement 60.

Figure 11:
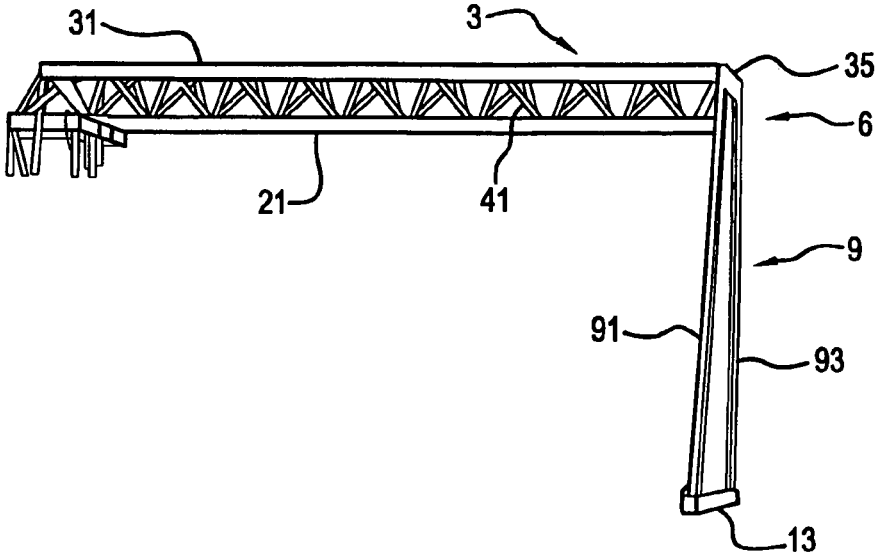
FIG. 11 is a perspective view of the gantry crane taken from the second end at the right of the perspective view shown in FIG. 9.

FIG. 11 is a perspective view of the gantry crane 1 taken from the second end 6 with the vertical support leg structure 9.

Figure 12:
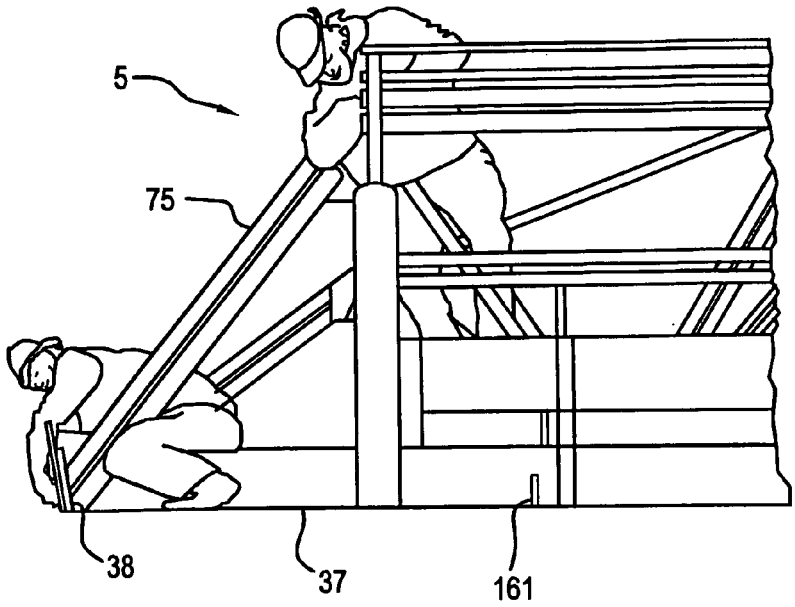
FIG. 12 is a perspective view detail of the upper first end showing bolted interconnections.

FIG. 12 shows bolting plates on the rigid leg structure to the end plate 33 which extends across the top of the end 5 of the main open three-dimensional horizontal beam 3 and to the sloping end plate 38 on the end 37 of the lower I-beam 21.

Figure 13:
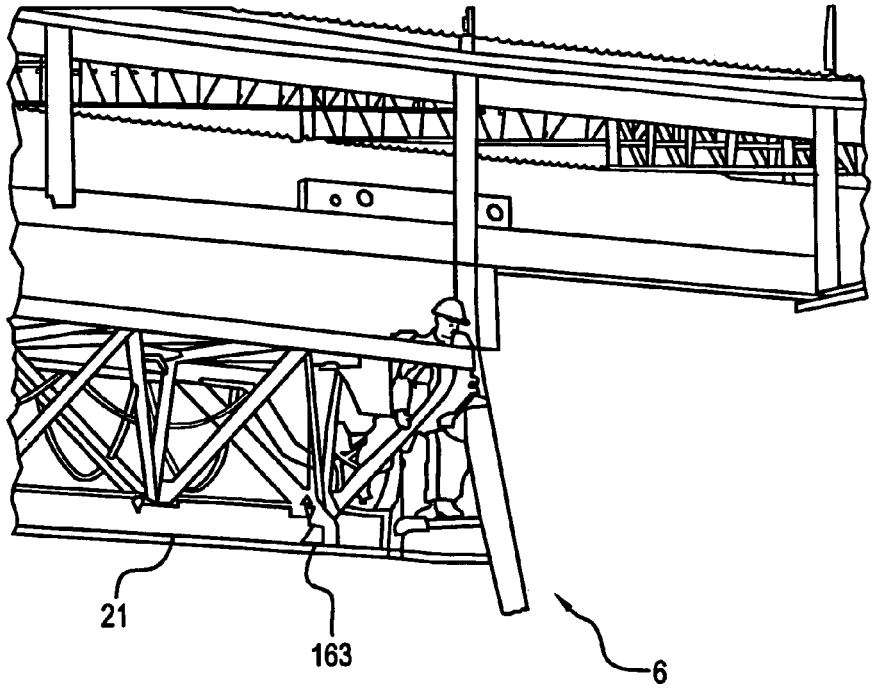
FIG. 13 is a perspective view detail of the upper second end showing bolted interconnections.

FIG. 13 shows the bolting of the plates at the top of the vertical support leg structure 9 to the end 6 of the crane.

The gantry crane may be shipped to the job site in major preassembled pieces erected at the job site and secured by bolting the sections together at five locations after the trolley is mounted on the lower beam 21 and stops 161 and 163 are mounted at opposite ends of the lower beam.

The rigidity of the leg structure 7, the rigidity of the main beam 3 and the rigidity of their interconnections at the end 5 provide stability and rigidity of the entire gantry crane. The vertical plate connections at the top of the vertical support leg structure 9 at end 6 of the beam 3 accommodates slight variations in track conditions. In preferred embodiments, the vertical support leg structure 9 is constructed of 8" steel tubes. The rigid leg support structure 7 is constructed of 6" steel tubes.

While the invention has been described with reference to specific embodiments, modifications and variations of the invention may be constructed without departing from the scope of the invention, which is defined in the following claims.

I claim:

1. Apparatus comprising a gantry crane having a rigid open three-dimensional horizontal beam having first and second ends, a rigid open three-dimensional first leg structure rigidly connected at the first end of the rigid open three-dimensional beam, and a vertically supporting second leg structure connected to the second end of the rigid open three dimensional beam, wherein the rigid leg structure comprises first and second upward and inward converging vertical legs and connection plates at the tops of the first and second legs for connection to a cross-beam and plates at the top of the open three-dimensional horizontal beam, and wherein a lower member of the horizontal beam has an extended first end which extends outward between the first and second legs, third and fourth upward extending, inward converging and outwardly sloping legs, a top plate connected to tops of the third and fourth outwardly sloping legs, and further comprising a complementary end plate connected to an end of the extended lower member and connected to the top plate at the tops of the third and fourth legs.

2. The apparatus of claim 1, further comprising flexible connectors connected tops of the second leg structure and connected between the tops of the leg structure and the second end of the beam.

3. The apparatus of claim 1, further comprising a transverse plate connected at the top of the second end of the beam and vertical plates connected between the end plate and to of the second leg structure, and wherein the leg structure further comprises first and second inward sloping tubes having upper ends connected to vertical plates in vertical planes and having lower ends connected to horizontal plates.

4. The apparatus of claim 3, further comprising a carriage housing having axles extending horizontally through the housing and wheels mounted on the axles, and wherein the horizontal plates are connected to the carriage housing.

5. The apparatus of claim 1, further comprising a carriage connected to bottoms of the first, second, third and fourth legs, axles connected to the carriage near ends of the carriage, and wheels connected to the axles.

6. The apparatus of claim 5, further comprising first and second horizontal plates connected respectively at bottoms of the first and third legs and the second and fourth legs and connected to the carriage.

7. The apparatus of claim 6, wherein the first, second, third and fourth legs are tubular legs.

8. The apparatus of claim 7, further comprising an inverted triangular rigidifying support connected between the first and second legs, the inverted triangular support having a downward pointing apex connected centrally to the carriage and vertical divergent support legs extending upwardly and outwardly from the apex, and a cross-member base extending between the two second legs.

9. The apparatus of claim 8, wherein the triangle support legs and base comprise tubular members.

10. The apparatus of claim 8, further comprising first, second and third medial support tubes respectively extending between the first and third, third and fourth and fourth and second legs at positions near the cross member base.

11. The apparatus of claim 1, further comprising angular support members extending between the end plate on the beam and the extended first end of the lower member.

12. The apparatus of claim 1, wherein the open three-dimensional beam comprises a longitudinally extending lower member having a vertical web and oppositely extending lower horizontal flanges for supporting a movable crane trolley, first and second spaced longitudinally extending upper members, upper cross-members extending between the first and second upper members, and angular gussets extending between the lower member and the first and second upper members.

13. The apparatus of claim 12, wherein the upper members comprise X-beams, and wherein the cross-members extending between the upper members comprise angle irons.

14. Apparatus comprising a gantry crane having a rigid open three-dimensional horizontal beam having first and second ends, a rigid open three-dimensional first leg structure rigidly connected at the first end of the rigid open three-dimensional beam, and a vertically supporting second leg structure connected to the second end of the rigid open three dimensional beam, wherein each upper member X-beam comprises two angle irons connected at intervals by downward and inward sloping plates and upward and inward sloping plates.

15. The apparatus of claim 14, wherein each gusset comprises two parallel members having upper end portions connected to the upward and outward extending plates, and further comprising upward and outward extending lower plates connected to the lower member, wherein each gusset has lower ends, and wherein lower ends of each gusset are connected to the upward and outward extending lower plates.

16. The apparatus of claim 15, wherein each upward and outward extending lower plate and downward and inward extending upper plate is connected to two gussets, and wherein gussets at the second end of the three-dimensional beam extend upward and diagonally outward and are connected to ends of the upper members and to the end cross-beams.

17. The apparatus of claim 15, wherein each gusset comprises spaced parallel elements which are connected at lower and upper ends respectively to the upward and outward extending plates and the downward and inward extending plates, and wherein the gussets have spacers connected between the two parallel elements at intervals along the gussets.

18. The apparatus of claim 14, wherein the upper cross-members extend angularly between the longitudinal upper members.

19. Apparatus comprising a gantry crane having a rigid open three-dimensional horizontal beam having first and second ends, a rigid open three-dimensional first leg structure rigidly connected at the first end of the rigid open three-dimensional beam, and a vertically supporting second leg structure connected to the second end of the rigid open three dimensional beam, further comprising a trolley having wheels mounted on outward extending flanges of the lower member, and having a drive motor operatively connected to at least one of the wheels for moving the trolley back and forth along the lower member, pulleys mounted on the trolley, a winding motor mounted on the trolley and connected to a reel, a cable connected to the reel and connected to the pulleys and to a movable sheath supported by multiple strands of the cable, and a hook supported by the movable sheath for lifting and lowering loads.

20. The apparatus of claim 19, further comprising carriages mounted on the lower ends of the leg structures at first and second opposite ends of the crane, axles mounted on the carriages, roller wheels mounted on the axles, and synchronous drive motors connected to wheels on the carriages for moving the carriages back and forth along rails.

21. Open three-dimensional beam apparatus comprising a longitudinally extending lower member having a vertical web and oppositely extending lower horizontal flanges for supporting a movable crane trolley, first and second spaced longitudinally extending upper members, upper cross-members extending between the first and second upper members, and angular gussets extending between the lower member and the first and second upper members, wherein each upper member X-beam comprises two angle irons connected at intervals by downward and inward sloping plates and upward and inward sloping plates.

22. The apparatus of claim 21, wherein the upper members comprise X-beams, and wherein the cross-members extending between the upper members comprise angle irons.

23. The apparatus of claim 21, wherein each gusset comprises two parallel members having upper end portions connected to the upward and outward extending plates, and further comprising upward and outward extending lower plates connected to the lower member, wherein each gusset has lower ends, and wherein lower ends of each gusset are connected to the upward and outward extending lower plates.

24. The apparatus of claim 23, wherein each upward and outward extending lower plate and downward and inward extending upper plate is connected to two gussets, and wherein gussets at the second end of the three-dimensional beam extend upward and diagonally outward and are connected to ends of the upper members and to the end cross-beams.

25. The apparatus of claim 23, wherein each gusset comprises spaced parallel elements which are connected at lower and upper ends respectively to the upward and outward exending plates and the downward and inward extending plates, and wherein the gussets have spacers connected between the two parallel elements at intervals along the gussets.

26. The apparatus of claim 21, wherein the upper cross members extend angularly between the longitudinal upper members.

27. Apparatus comprising a gantry crane having an open three dimensional horizontal beam and legs extending downward from the beam, the beam having a triangular cross section with an upper base and a lower apex and having two elongated upper members and one elongated lower member, angularly related cross members welded between the upper members, and angularly related side members joined between each of the upper members and the lower member, hereby creating the open three dimensional horizontal beam, wherein the legs comprise a first three dimensional leg structure connected to a first end of the beam and a second two dimensional leg structure connected to a second end of the beam, the second leg structure comprising two inwardly sloping legs and a plate connected to upper ends of the two legs and connected to second ends of the upper members, the first leg structure comprising first and second inwardly sloping legs, a plate connected to upper ends of the first and second legs and connected to first ends of the upper members, and third and fourth inward sloping legs having lower ends connected to lower ends of the first and second legs respectively and having upper ends connected to each other and connected to a first end of the lower member.

28. The apparatus of claim 27, wherein the two upper members comprise two X-beams, each X-beam formed of two elongated angle iron members joined by welding at their angles, wherein the lower member comprises an I-beam.

29. The apparatus of claim 28, wherein the I-beam is formed of two channel beams welded back to back.

* * * * *